US007357198B2

(12) United States Patent
Mcgarian et al.

(10) Patent No.: US 7,357,198 B2
(45) Date of Patent: Apr. 15, 2008

(54) DOWNHOLE APPARATUS

(75) Inventors: Bruce Mcgarian, Aberdeen (GB); Rory McCrae Tulloch, Aberdeen (GB); Neil Andrew Moir, Aberdeen (GB)

(73) Assignee: Smith International, Inc., Houston, TX (US)

( * ) Notice: Subject to any disclaimer, the term of this patent is extended or adjusted under 35 U.S.C. 154(b) by 52 days.

(21) Appl. No.: 10/543,094

(22) PCT Filed: Jan. 26, 2004

(86) PCT No.: PCT/GB2004/000286

§ 371 (c)(1),
(2), (4) Date: Apr. 18, 2006

(87) PCT Pub. No.: WO2004/065756

PCT Pub. Date: Aug. 5, 2004

(65) Prior Publication Data

US 2006/0225885 A1 Oct. 12, 2006

(30) Foreign Application Priority Data

Jan. 24, 2003 (GB) ..... 0301699.5

(51) Int. Cl.
*E21B 17/18* (2006.01)

(52) U.S. Cl. ..... 175/214; 175/215; 166/319

(58) Field of Classification Search ..... 175/324, 175/317, 214, 215; 166/331, 319
See application file for complete search history.

(56) References Cited

U.S. PATENT DOCUMENTS

| | | | |
|---|---|---|---|
| 4,276,931 | A | 7/1981 | Murray |
| 6,289,999 | B1 | 9/2001 | Dewey et al. |
| 6,401,822 | B1 | 6/2002 | Baugh |

FOREIGN PATENT DOCUMENTS

| | | |
|---|---|---|
| GB | 2 377 234 | 1/2003 |

*Primary Examiner*—Jennifer H. Gay
*Assistant Examiner*—Brad Harcourt
(74) *Attorney, Agent, or Firm*—Dykema Gossett PLLC

(57) ABSTRACT

The invention relates to apparatus for use in wellbores and particularly, but not exclusively, to circulating subs used during downhole drilling operations. The apparatus includes a control groove and a pin received within the control groove for determining whether or not a longitudinal movement of a piston in a given direction relative to the apparatus body will move the apparatus between open and closed configurations. The apparatus further includes a control member located between and movable relative to the body and the piston. The control groove is defined in one of the piston and control member, and the pin is provided on the other of the piston and control member. Means are also provided for constraining movement of the piston relative to the body to longitudinal movement only. The invention thus provides an apparatus which has improved reliability in moving between open and closed configurations.

11 Claims, 3 Drawing Sheets

DOWNHOLE APPARATUS

The invention relates to apparatus for use in well bores and particularly, but not exclusively, to circulating subs used during downhole drilling operations.

In a conventional multi-cycle circulating sub, a cylindrical piston is generally provided for axial movement within a sub housing between an open position, in which well bore fluid may flow between the annulus and the interior of the sub housing by means of apertures in said housing, and a closed configuration, in which the piston covers the apertures so as to prevent a flow of well bore fluid therethrough. Typically, the piston is biased uphole by means of a spring and, in use, is pressed downhole by a predetermined rate of fluid flow through the sub housing. However, in order to allow the fluid to be pumped through the sub housing at said predetermined flow rate without the circulating sub moving from its current open or closed configuration, movement of the piston is controlled by means of a pin and groove arrangement.

More specifically, a control groove is typically provided in the outer surface of the piston as a closed loop about the longitudinal axis of the piston. At least one control pin is secured to the sub housing so as to extend into the control groove. Movement of the piston relative to the sub housing is therefore limited by movement of the control pin within the control groove. The control groove is shaped so that, on at least one application of the predetermined fluid flow rate downhole through the sub housing, the piston is allowed to move axially but prevented from changing the open or closed configuration of the circulating sub. In moving axially, the piston rotates within the sub housing as the control pin moves circumferentially within the control groove. It will be understood by those skilled in the art that, by reducing the rate of fluid flow, the piston may be pressed uphole by the biasing means and be further rotated by a further relative movement between the control pin and groove. Although the piston has been cycled between uphole and downhole positions, it will be appreciated that, with an appropriate positioning of housing apertures relative to the piston, no change in the open or closed configuration of the circulating sub need occur. However, the control groove may be shaped so that after a predetermined number of piston cycles, the pin is located in a portion of control groove which extends a sufficient axial distance to permit the pistol to be moved downhole by said predetermined flow rate and thereby change the open/closed configuration. Thus, the open/closed configuration of the circulating sub will be changed only after a predetermined number of applications of the aforementioned fluid flow rate. The use of fluid flow rate above the level required to move the piston is not therefore prevented by use of the circulating sub.

It will, however, be apparent that the control pin and groove arrangements of the above prior art circulating sub causes the piston to rotate with a helical motion. In other words, the piston moves with both axial and rotational components. However the rotational movement can be undesirable in that the piston can stick during the spring return cycle with the control pin being driven back along the portion of control groove from which it has just moved. Also, in a circulating sub having an open configuration wherein fluid flows through the housing apertures to the annulus via flow ports in the wall of the cylindrical piston, care must be taken during the design, manufacture and assembly of the sub to ensure that the piston ports align with the housing apertures when the piston is in the open axial position or to ensure that means, such as a circumferential housing recess in the region of the apertures, is provided in order to allow fluid communication between misaligned piston ports and housing apertures.

A bypass valve according to the preamble of the appended independent claim 1 is disclosed in the applicant's U.S. Pat. No. 6,289,999 B1. However, the piston of this prior art bypass valve is rotatable relative to both the apparatus body and a sleeve (located between the piston and body) in which a control groove is defined. A problem with this arrangement is that rotational movement of the piston (arising from a swirling fluid flow in the piston bore or some other event) independent of the relative movement between the control groove and associated control pin can cause the pin to undesirably move backwards within the control groove and prevent the apparatus from moving between open and closed configurations as expected.

It will be understood by those skilled in the art that a bypass valve differs from a circulating sub (to which the present invention particularly relates) in that a bypass valve is normally located in an open configuration so as to allow fluid communication between the annulus and the valve interior. A multi-cycle bypass valve will generally cycle several times whilst remaining open before moving to a closed configuration. A multi-cycle circulating sub will, in contrast, generally cycle several times whilst remaining in a closed configuration before opening to allow fluid communication with the annulus.

It is an object of the present invention to provide downhole apparatus comprising a device for opening and closing the apparatus which has improved reliability.

A first aspect of the present invention provides a downhole apparatus for selectively isolating the interior of a downhole assembly from the exterior thereof, the downhole apparatus comprising: a body defining a longitudinally extending bore and incorporating a wall having at least one aperture therein for providing fluid communication between said bore and the exterior of the downhole apparatus; a piston located within the body and slidable longitudinally therein so as to allow movement of the downhole apparatus between an open configuration, in which said at least one aperture is open to permit fluid communication between said bore and the exterior of the downhole apparatus via said at least one aperture, and a closed configuration, in which said at least one aperture is occluded by the piston to restrict fluid communication between said bore and the exterior of the downhole apparatus via said at least one aperture; a control groove and a pin received within the control groove for determining whether or not a longitudinal movement of the piston in a given direction will move the downhole apparatus between open and closed configurations; and a control member located between and movable relative to the body and the piston, the control groove being defined in one of the piston and control member, and the pin being provided on the other of the piston and control member; the downhole apparatus being characterized in that means are provided for constraining movement of the piston relative to the body to longitudinal movement only.

Thus, in the present invention the piston is prevented from moving in a rotational direction relative to the body by constraining means. In this way, rotational forces applied to the piston by, for example, a swirling fluid flow or apparatus located within the piston bore, are prevented from being transferred to the control groove or control pin and, accordingly, the risk of the control pin undesirably moving backwards within the control groove is reduced.

Preferably, said means for constraining relative movement between the piston and the body comprises a straight groove extending in a longitudinal direction, said straight groove being provided on one of the piston and body, and a portion of the other of the piston and body being received within said groove. Said portion of the piston or body may be provided as a discrete pin separate from the piston or body. Also, the constraining means may, in use, limit the extent of longitudinal movement of the piston relative to the body. Furthermore, the piston may be biased in a longitudinal direction by biasing means towards a plurality or positions relative to the body in which the downhole apparatus is in a closed position, and the control groove is adapted to allow movement from the closed configuration to the open configuration only after a predetermined number of longitudinal movements of the piston against the bias of the biasing means.

It is particularly desirable for means to be provided for preventing longitudinal movement of the control member relative to the body. Said means for preventing movement of the control member may comprise a groove extending in a plane perpendicular to the direction of longitudinal movement and a pin located in said groove; the groove being defined in one of the body and control member, and the pin being provided on the other of the body and control member.

The piston may be releasably secured to the body by means of a collet when moved to a predetermined longitudinal position relative to the body. Only one portion of the control groove may permit movement of the piston to said predetermined longitudinal position relative to the body so as to allow the piston to become secured to the body by means of the collet.

A second aspect of the present invention provides a circulating sub for selectively isolating the interior of a downhole assembly from the exterior thereof the circulating sub comprising: a body defining a longitudinally extending bore and incorporating a wall having at least one aperture therein for providing fluid communication between said bore and the exterior of the sub; a piston located within the body and slidable longitudinally therein so as to allow movement of the sub between an open configuration, in which said at least one aperature is open to permit fluid communication between said bore and the exterior of the sub via said at least one aperture, and a closed configuration, in which said at least one aperture is occluded by the piston to restrict fluid communication between said bore and the exterior of the sub via said at least one aperture; a control groove and a pin received within the control groove for determining whether or not a longitudinal movement of the piston in a given direction will move the sub between open and closed configurations; and a control member located between and movable relative to the body and the piston, the control groove being defined in one of the piston and control member.

Also, the control groove may define a closed loop about (i.e. circumscribing) a longitudinal axis of the apparatus Embodiments of the present invention will now be described with reference to the accompanying drawings, in which.

Figure 1:
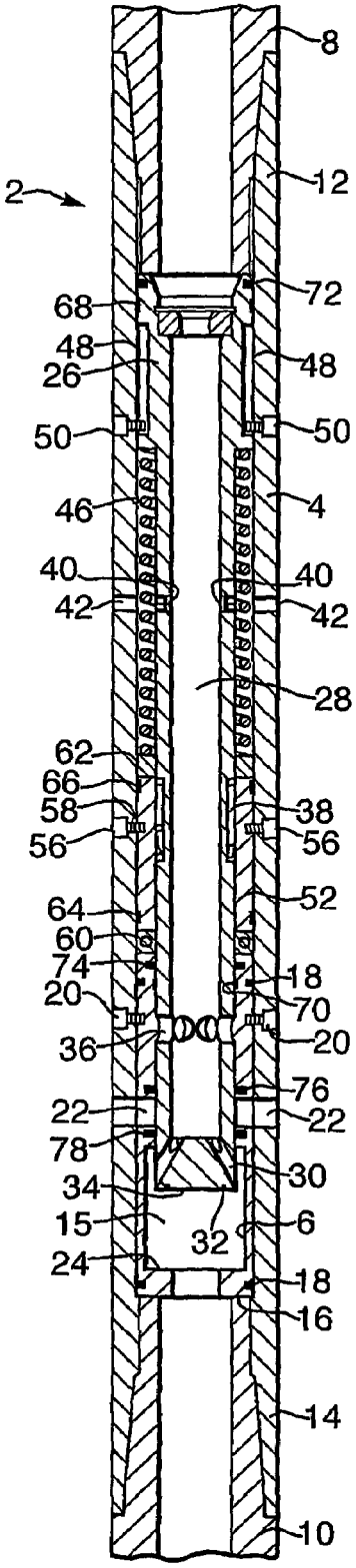
FIG. 1 is a cross-sectional side view of a first embodiment of the present invention with a piston located in an uphole closed position.

A first multi-cycle circulating sub 2 according to the present invention is shown in FIGS. 1-4 of the accompanying drawings. The circulating sub 2 is moveable between a closed configuration, in which all wellbore fluid is directed through the interior of the sub, and an open configuration, in which all wellbore fluid is directed to the exterior for of the sub.

The sub 2 includes a housing in which a number of internal components are mounted For ease of manufacture and assembly, the housing is itself made up of several components. The housing components include a principal cylindrical body component 4, an internal cylindrical body component (a lower sleeve) 6, and uphole and downhole cylindrical crossover members 8,10. The crossover members 8,10 are threadedly connected to respective uphole and downhole ends 12, 14 of the principal body component 4. The uphole crossover member 8 has an internal screw thread at its uphole end (not shown) for screw-threaded engagement with a portion of equipment string to be located uphole of the sub 2. Similarly, the downhole crossover member 10 is provided with an external screw thread at its downhole end (not shown) for screw threaded engagement with a portion of equipment string to be located downhole of the sub 2.

The internal body component 6 locates within a bore 15 of the principal body component 4 in abutment with an uphole facing shoulder 16 defined by the downhole crossover member 10. A seal 18 is provided between the principal body component 4 and the internal body component 6 at the uphole and downhole ends of said internal body component 6. The internal body component 6 is fixedly secured to the principal body component 4 by means of two pins 20 extending from the principal body component 4 into recesses in the internal body component 6. Axial movement between the principal body component 4 and the internal body component 6 is thereby prevented. Furthermore, six vent apertures 22 extend transversely through the principal body component 4 and the internal body component 6 so as to allow, in use, well bore fluid to vent from the piston bore 28 to the exterior of the sub 2. The internal diameter of the internal body component 6 is increased downhole of the apertures 22 so that, in use, well bore fluid may flow from laterally extending ports in a piston (described in greater detail below) and into equipment located below the sub 2. The internal diameter of the internal body component is increased at the lower end of said component 6 so as to provide an uphole facing annular shoulder 24 for closing the aforementioned piston flow ports when the piston is located in the open position (see FIG. 4).

Figure 2:
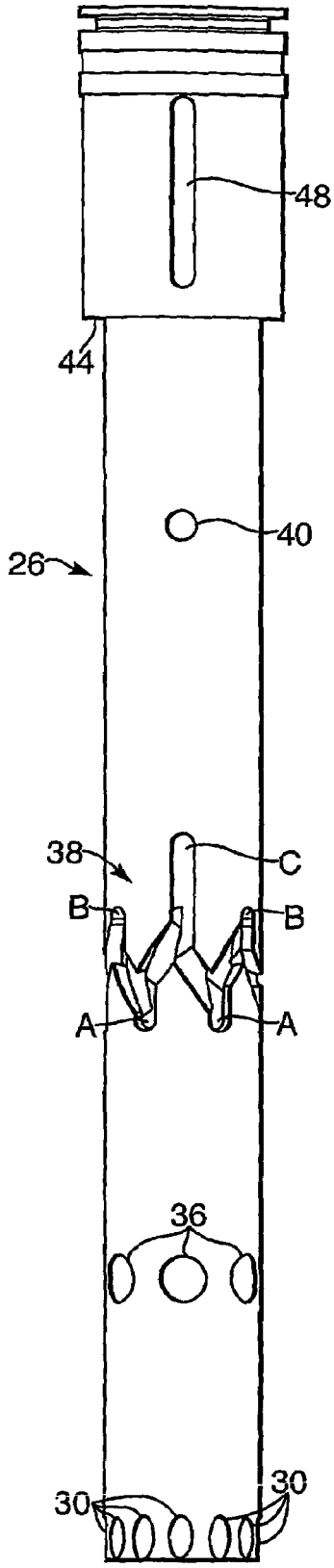
FIG. 2 is a side view of the piston shown in FIG. 1.

The piston referred to above is one of the internal components mounted in the housing of the circulating sub 2. An isolated view of the piston 26 is shown in FIG. 2. The piston 26 has a generally cylindrical shape with an internal bore 28 extending therethrough. The downhole end of the piston bore 28 is sealed, although well bore fluid may flow from the bore 28 by means of twelve laterally extending flow ports 30. The flow ports 30 extend outwardly and downwardly from the piston bore 28 so as to direct fluid into the portion of the internal body component 6 having an increased internal diameter. An O-ring seal 32 is located radially inwardly of the outlets to the flow ports 30 on a downward facing downhole end surface 34 of the piston 26 (see FIG.

1). When the piston 26 is located in the open position, the O-ring seal 32 abuts the upwardly facing shoulder 24 of the internal body component 6. Well bore fluid is thereby prevented from flowing into equipment located downhole of the sub 2.

Figure 6:
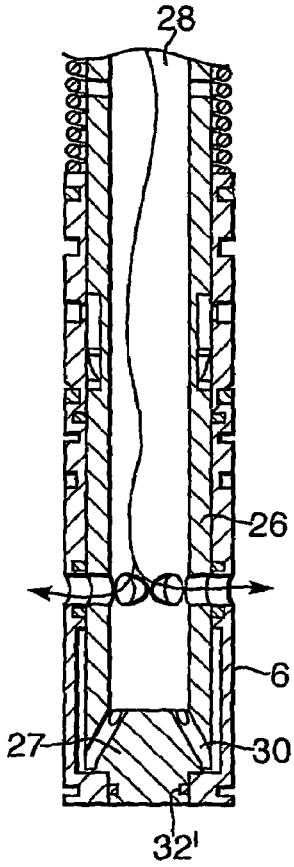
FIG. 6 is a cross-sectional side view of part of the first embodiment with a modified piston.

In order to avoid the O-ring seal 32 from being undesirably pulled from the piston 26 by fluid flow, the downhole end of the piston 26 may be modified as shown in FIG. 6 of the accompanying drawings. With reference to this Figure, it will be seen that the downhole end of the piston 26 is provided with a downwardly projecting cylindrical extension 27 which is sized so as to be locatable within the aperture 25 defined in the lowermost portion of the internal body component 6. The arrangement is such that the extension 27 sealingly engages said aperture 25. This may be achieved by providing the extension 27 and the aperture 25 with a taper so that both the extension 27 and the aperture 25 reduce in diameter in a downhole axial direction. This tapering only needs to be relatively small and is not visible in the illustration of FIG. 6. An O-ring seal 32' is provided (optionally) between the mating surfaces (preferably on the outer diameter surface of the extension 27).

Uphole of the piston flow ports 30, the piston 26 is provided with six vent apertures 36 which are each located so as to align with a corresponding vent aperture 22 when the piston 26 is in the open position. With the piston vent apertures 36 so located, well bore fluid may flow from the piston bore 28 into the well bore annulus.

A control groove 38 is defined in the outer surface of the piston 26 uphole of the vent apertures 36. The control groove 38 is of a conventional nature and circumscribes the piston 26 to form a closed loop. The control groove 38 is shaped so that a pin located therein will move circumferentially along the groove in response to reciprocating axial movement of the piston 26. However, as will be readily understood by those sled in the art, the extent of axial piston movement is restricted by the interaction of the pin with the groove and is determined by the particular portion of groove in which the pin is located at any given time. If the pin is not located in a portion of groove capable of allowing the required extent of axial piston movement, then it will be understood that the piston may be reciprocated back and forth until the pin locates in a portion of groove allowing the required movement. Uppermost and lowermost piston positions may be determined by shoulders on the body bore 15 so as to reduce the risk of damage to the or each pin with the control groove (see below).

Two spring chamber vent apertures 40 extend laterally through the wall of the piston 26 uphole of the control groove 38. In use, the vent apertures 40 may be used to assist in preventing a hydraulic locking of the piston 26. However, in the preferred embodiment shown in FIGS. 1 to 3, a hydraulic locking of the piston 26 is prevented by means of two spring chamber vent apertures 42 defined in the principal body component 4 and the vent apertures 40 in the piston 26 are occluded with appropriate plugs.

The outer diameter of the piston 26 increases at the piston upper end so as to define a downward facing annular shoulder 44. In the assembled circulating sub 2, a helical spring 46 is located so as to press upwardly on the shoulder 44 and thereby bias the piston 26 in an uphole direction.

In addition to the control groove 38, two further grooves 48 are provided in the exterior surface of the piston 26 uphole of the shoulder 44. The two grooves 48 each extend in an axial direction only. When the piston 26 is assembled within the bore 15 of the sub housing, two pins 50 secured to the principal body component 4 extend into the grooves 48. Each of the axially extending grooves 48 receive one pin 50. More or less than two grooves 48 may be provided as necessary. Since the grooves 48 extend in an axial direction only, it will be understood that, in the assembled circulating sub 2, the piston 26 is restrained by the pins 50 from rotating within the bore 15 and is capable only of moving in an axial direction. The length of the grooves 48 is such that the pins 50 do not limit the axial movement of the piston 26 (although the grooves 48 and pins 50 may be used for this purpose with appropriate modification of the groove 48 length and position). In the embodiment shown in FIGS. 1 to 4, uphole movement of the piston 26 is limited by abutment of the piston 26 with the uphole crossover member 8 and downhole movement of the piston 26 is limited by abutment of the piston 26 with the shoulder 24.

Figure 3:
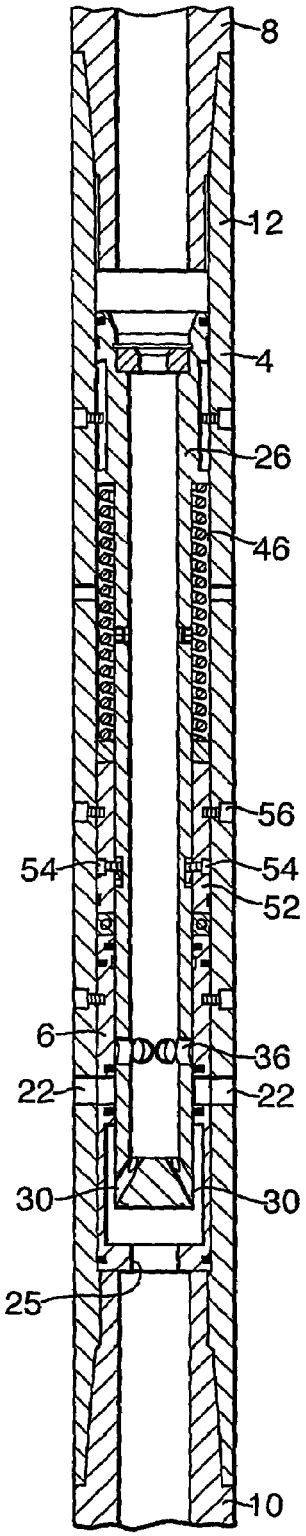
FIG. 3 is a cross-sectional side view of the first embodiment with the piston located in a downhole closed position.
Figure 4:
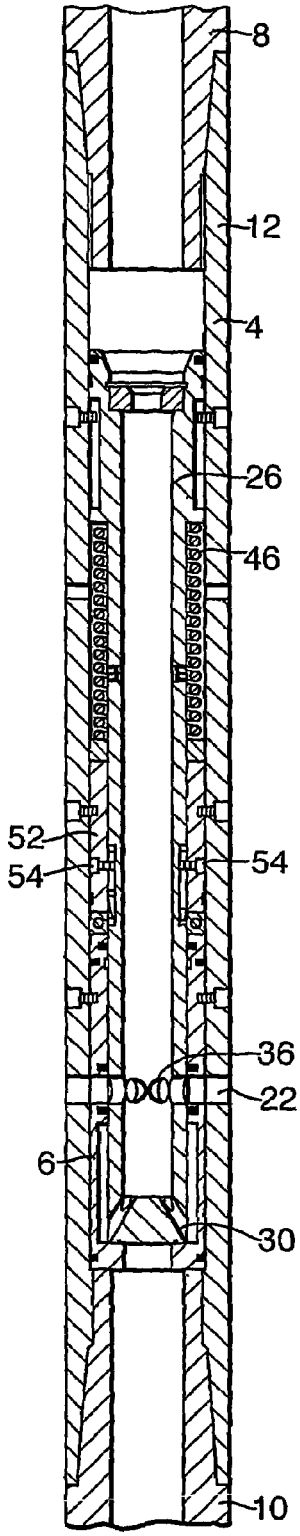
FIG. 4 is a cross-sectional side view of the first embodiment with the piston located in an open position.

With the piston 26 located in the bore 15, a chamber is defined between the piston 26, the principal body component 4 and the internal body component 6. This chamber houses the helical spring 46, two bearing raceways 60,62 (see below) and a cylindrical sleeve 52 to which two control pins 54 are secured (see FIGS. 3 and 4). Due to the rotational position of the pin sleeve 52, the pins 54 are not visible in FIG. 1. With reference to FIGS. 3 and 4, it will be seen that the two control pins 54 extend from the inner surface of the pin sleeve 52 so as to locate within the control groove 38 defined in the piston 26. It will be understood that, as the piston 26 moves axially within the housing without relative rotation therewith (as a consequence of the axial grooves 48 and pins 50), the control groove 38 moves relative to the two control pins 54 and, as a result, the pin sleeve 52 is forcibly rotated relative to the piston 26 and the housing. In order to prevent axial movement of the pin sleeve 52 relative to the housing, two restraining pins 56 extend through the principal body component 4 into an annular groove 58 in the exterior surface of the pin sleeve 52. The annular groove 58 circumscribes the pin sleeve 52 and lies in a single plane extending perpendicularly to the longitudinal axis of the sub 2. The restraining pins 56 and groove 58 function to prevent uphole movement of the pin sleeve 52 in particular. Downhole movement of the pin sleeve 52 is limited by the internal body component 6 as well as the restraining pins 56. It is to be noted that the restraining pins 56 are not visible in FIG. 3 due to the angle at which the cross-section view has been taken.

The rotational movement of the pin sleeve 52 is assisted by means of two bearings 60,62 and two slyd or wear rings 64,66. The first bearing 60 located between the downhole end of the pin sleeve 52 and the uphole end of the internal body component 6. The second bearing 62 is located between the uphole end of the pin sleeve 52 and the downhole end of the spring 46. The slyd or wear rings 64,66 are located adjacent the bearings 60,62 between the pin sleeve 52 and the principal body component 4. The axial movement of the piston 26 is assisted by means of a slyd or wear ring 68 located between the uphole end of the piston 26 and the principal body component 4 and a slyd or wear ring seal 70 located between the piston 26 and the internal body component 6. In this way, frictional forces resisting axial movement of the piston 26 relative to the housing are reduced. Also, glyd ring seals 72,74,76,78 prevent the passage of well bore fluid between the piston 26 and the sub housing.

In order to vary the rate of fluid flow through the piston bore 28 required to move the piston 26 axially downhole against the uphole bias of the spring 46, a nozzle 80 (provided with an appropriate seal) may be located within the piston bore 28 so as to increase pressure losses and allow a greater force to be exerted on the piston 26 by a given fluid flow. The size of the nozzle 80 may of course be varied so as to vary the fluid flow required to generate a force necessary to overcome the spring bias.

When the spring chamber is vented by means of the apertures 42 in the principal body component 4 and the apertures 40 in the piston are occluded (as in the preferred embodiment of FIGS. 1-4), hydraulic thrust acting on the piston to move it downwards is supplemented by the pressure drop between the interior and exterior of the closed valve as the spring chamber is at the annulus pressure.

In use, the piston 26 may be located in a closed position as shown in FIG. 1 so that fluid may be pumped through the circulating sub to equipment located downhole thereof. With the piston 26 located in the closed position shown in FIG. 1, each of the control pins 54 is located in one of the lowermost portions A of the control groove 38 (see FIG. 2). In this piston position, fluid may flow through the piston bore 28 and into equipment located downhole via the piston flow ports 30. If the fluid rate increases to such an extent that the bias of the spring 46 is overcome, then the piston 26 will be pressed downhole by the fluid flow. In moving downhole, the piston 26 is restrained by the grooves 48 and pins 50 from rotating relative to the housing. However, as the piston 26 moves axially relative to the housing, the pin sleeve 52 rotates and the control pins 54 move to a different portion of the control groove 38.

If the control pins 54 are initially located within the control groove 38 so as to each move to a portion B of the control groove 38 upon axial movement of the piston 26, then movement of the piston 26 to the open position (as shown in FIG. 4) will be prevented. Thus, fluid may still be pumped to fluid located below the sub 2. If the fluid flow rate is reduced sufficiently, the spring 46 will move the piston 26 back uphole into abutment with the uphole cross-over member 8. In moving uphole, the piston 26 does not rotate due to the constraining influence of the grooves 48 and pins 50. However, the pin sleeve 52 does rotate and each control pin 54 moves to a new portion A of the control groove 38.

The profile of the control groove 38 is such that movement of each control pin 54 from some (but not all) lowermost portions A of the control groove 38, as the piston 26 moves downhole, allows each control pin 54 to locate in uppermost portions C of the control groove 38. With each control pin 54 located in an uppermost portion C of the control groove 38, the piston 26 is located in its lower most position relative to the housing with the downward facing piston end 34 abutting the upward facing shoulder 24 of the internal body component 6. With the piston 26 located in this open position (see FIG. 4), the piston flow ports 30 are closed so as to prevent fluid flow to equipment below the sub 2, however the piston vent apertures 36 are aligned with the housing vent apertures 22 so as to allow fluid to flow to the exterior of the sub 2. The piston 26 will remain in the open position until the fluid flow rate is reduced to a level below that necessary to overcome the spring bias. The piston 26 will then be pressed by the spring 46 uphole into abutment with the uphole crossover member 8. In so doing, the housing vent apertures 22 are closed and each control pin 54 moves to a lowermost portion A of the control groove 38. This cyclical movement of the piston 26 between up (closed), half down (closed) and fully down (open) positions may continue as long as necessary due to the closed loop arrangement of the control groove 38. This combined use of a control groove and pin is well known in the art and will be readily understood by a skilled reader. However, it will be noted that the axial grooves 48 in combination with the associated pins 50 prevent rotation of the piston 26 relative to the housing and all rotating parts of the circulating sub 2 are encapsulated between the piston 26 and the sub housing.

The position of the piston 26 relative to the sub housing when each control pin 54 is located at a portion B of the control groove 38 is shown in FIG. 3 of the accompanying drawings. It will be seen that, although the piston 26 has moved downwardly relative to the sub housing, the piston flow ports 30 remain open and the housing vent apertures 22 remain closed.

Figure 5:
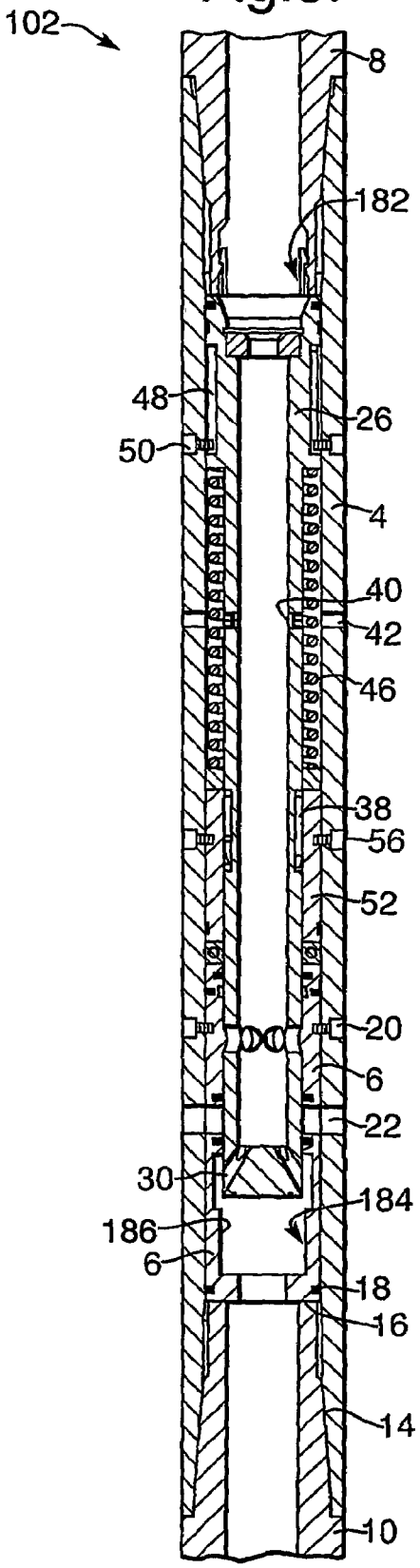
FIG. 5 is a cross-sectional side view of a second embodiment of the present invention with a piston located in an uphole closed position.

A further circulating sub 102 is shown as a second embodiment in FIG. 5 of the accompanying drawings. This further circulating sub 102 is identical to the first circulating sub 2 in all but two respects and like components have been identified with like reference numerals. The two modifications in the further circulating sub 102 are the provision of a collet system 182 for releasably securing the piston 26 to the uphole crossover member 8 and the provision of means 184 for providing a user at the surface with a pressure rise indication when the piston 26 moves to the half down position.

With regard to the collet system 182, it will be seen that the uphole end of the piston 26 is provided with upwardly extending collet fingers which engage a shoulder on the uphole crossover member 8. The engagement of the collet fingers releasably locks the piston 26 to the uphole crossover member 8. However, the engaged collet fingers may be released from the shoulder of the uphole crossover member 8 by applying a predetermined downhole force to the piston 26 by means of an appropriate flow of well bore fluid therethrough. Thus, fluid flow rates may be used which would otherwise cause the control pins 54 to cycle through the control groove 38. The control groove 38 may be designed so that the piston 26 is able to move sufficiently uphole for the collet fingers to engage with the shoulder only once during a complete cycle of the control pins 54 within the control groove 38. Alternatively, the groove design may be such that the collet fingers engage the shoulder on every spring return of the piston. It will be understood that the benefit of the collet system is that the sub 102 may be held in a closed configuration, without the piston being cycled, whilst fluid flow rates typically used for drilling operations pass through the sub. The restricted piston cycling also reduces wear, particularly of the glyd and slyd rings.

The means 184 for providing a pressure rise indication comprises a step 186 which reduces the internal diameter of the internal body component 6 in the region in which the piston flow ports 30 locate when the piston 26 is in the half down position. In other words, when the control pins 54 move to portions B of the control groove 38, the outlets to the piston flow ports 30 are effectively moved closer to the internal body component 6 so that the cross-sectional area of the fluid flow path is reduced. As a result of the reduction in flow path area, a pressure rise is generated which can be detected at the surface. This pressure rise indicates to the user of the circulating sub 102 that the piston 26 has moved to the half down position. Fluid may nevertheless pass through the sub 102 to equipment located downhole thereof.

The present invention is not limited to the specific embodiments described above. Further embodiments will be apparent to a reader skilled in the art.

The invention claimed is:

1. Downhole apparatus for selectively isolating the interior of a downhole assembly from the exterior thereof, the downhole apparatus comprising: a body defining a longitudinally extending bore and incorporating a wall having at least one aperture therein for providing fluid communication between said bore and the exterior of the downhole apparatus; a piston located within the body and slidable longitudinally therein so as to allow movement of the downhole apparatus between an open configuration, in which said at least one aperture is open to permit fluid communication between said bore and the exterior of the downhole apparatus via said at least one aperture, and a closed configuration, in which said at least one aperture is occluded by the piston to restrict fluid communication between said bore and the exterior of the downhole apparatus via said at least one aperture; a control groove and a pin received within the control groove for determining whether or not a longitudinal movement of the piston in a given direction will move the downhole apparatus between open and closed configurations; and a control member located between and movable relative to the body and the piston, the control groove being defined in one of the piston and control member, and the pin being provided on the other of the piston and control member; the downhole apparatus being characterized in that means are provided for constraining movement of the piston relative to the body to longitudinal movement only.

2. Downhole apparatus as claimed in claim 1, wherein said means for constraining relative movement between the piston and the body comprises a straight groove extending in a longitudinal direction, said straight groove being provided on one of the piston and body, and a portion of the other of the piston and body being received within said groove.

3. Downhole apparatus as claimed in claim 2, wherein said portion of piston or body is provided as a discrete pin separate from the piston or body.

4. Downhole apparatus as claimed in claim 1, wherein, in use, said constraining means limits the extent of longitudinal movement of the piston relative to the body.

5. Downhole apparatus as claimed in claim 1, wherein the piston is biased in a longitudinal direction by biasing means towards a plurality of positions relative to the body in which the downhole apparatus is in a closed position, and the control groove is adapted to allow movement from the closed configuration to the open configuration only after a predetermined number of longitudinal movements of the piston against the bias of the biasing means.

6. Downhole apparatus as claimed in claim 1, wherein means are provided for preventing longitudinal movement of the control member relative to the body.

7. Downhole apparatus as claimed in claim 6, wherein said means for preventing movement of the control member comprises a groove extending in a plane perpendicular to the direction of longitudinal movement and a pin located in said groove; the groove being defined in one of the body and control member, and the pin being provided on the other of the body and control member.

8. Downhole apparatus as claimed in claim 1, wherein the piston is releasably secured to the body by means of a collet when moved to a predetermined longitudinal position relative to the body.

9. Downhole apparatus as claimed in claim 8, wherein only one portion of the control groove permits movement of the piston to said predetermined longitudinal position relative to the body so as to allow the piston to become secured to the body by means of the collet.

10. Downhole apparatus as claimed in claim 1, wherein said apparatus is a circulating sub.

11. Downhole apparatus as claimed in claim 1, wherein the control groove defines a closed loop circumscribing a longitudinal axis of the apparatus.

* * * * *